US005643157A

United States Patent [19]

Seliber

[11] Patent Number: 5,643,157

[45] Date of Patent: Jul. 1, 1997

[54] FLUID COUPLING DRIVEN EXERCISE DEVICE

[76] Inventor: Joseph Seliber, 7437 N. Washtenaw Ave., Chicago, Ill. 60645

[21] Appl. No.: 605,764

[22] Filed: Feb. 22, 1996

[51] Int. Cl.[6] ..... A63B 21/008

[52] U.S. Cl. ..... 482/112; 482/9

[58] Field of Search ..... 482/9, 111, 112, 482/113

[56] References Cited

U.S. PATENT DOCUMENTS 2,823,896 2/1958 Hood, II .
4,842,274 6/1989 Oostbuizen et al. .
4,889,108 12/1989 Bond et al. ..... 482/9
5,015,926 5/1991 Casler .

*Primary Examiner*—Lynn A. Reichard
*Attorney, Agent, or Firm*—Marshall, O'Toole, Gerstein, Murray & Borun

[57] ABSTRACT

An exercise device comprising a variable speed rotary driving device, an adjustable speed control for the rotary driving device, an exercise link offering resistance to motion of the user, and a hydraulic coupling connecting the variable speed rotary driving device to a torque multiplier. The exercise device operates such that torque is transmitted to the exercise link to impart resistance to motion of the link, and the resistance to motion is variable and also a consistent function of the speed and direction of the link and of the variable speed rotary driving device.

9 Claims, 2 Drawing Sheets

FLUID COUPLING DRIVEN EXERCISE DEVICE

BACKGROUND OF THE INVENTION

Resistance exercise equipment now in use in commercial fitness facilities consists almost exclusively of free weights and selectorized or stacked weight cable machines. This type of equipment has the advantage of a relatively low initial cost and simplicity of construction. However, such resistance exercise equipment does not provide the user the most effective method of building stronger muscles or obtaining the equivalent muscle building results in less time.

Various complex computer operated devices have been proposed which have these benefits, but they have not found favor in the marketplace for a variety of reasons, not the least of which is the considerable cost thereof.

The present invention is specifically designed to bridge the rather large gap which exists between weighted exercise equipment and costly, complex computer operated exercise machines. This is accomplished by eliminating the use of weights or gravity forces while at the same time making it possible to permit high velocity, sports specific training. Further, the present invention provides what is known as a "heavy negative" option previously available only in computer operated devices or with partner assistance in the case of free weights.

"Heavy negative" is a method of resistance training in which the resistance to extension of the muscle is greater than the resistance to contraction of the muscle. It is a proven method of increasing the work load and directly building increased strength in a much shorter period of time. Extension resistance can be twenty to forty percent greater than contraction resistance depending upon the muscle being exercised.

Another advantage of this invention is that it is suitable for rehabilitation purposes. This follows because of the fact that the user can set very light resistances. Further, small changes in resistance can be made with digital dial-type controls.

Among earlier attempts, U.S. Pat. No. 2,823,896 to Hood discloses the use of a fluid coupling and a variable speed prime mover. This patent illustrates a method for positioning a load which is connected to the output shaft of the fluid coupling by varying the input speed to the fluid coupling, but it differs in structure from the present invention since the fluid coupling is mounted in the high torque portion of the system rather than in the low torque, high speed portion of the system. U.S. Pat. No. 2,823,896 to Hood utilizes controls which are not designed to allow the device to perform as a variable resistance training device.

U.S. Pat. No. 4,842,274 to Oosthuizen et al. discloses a device which provides a substantially constant resistance to user motion by maintaining a high speed differential between the motor and the cable drum. This can only be achieved by placing the hydraulic coupling in the high torque, low speed portion of the system, much like Hood U.S. Pat. No. 2,823,896. As previously noted, the present invention mounts the hydraulic coupling in the low torque, high speed portion of the system. This provides the advantage of using a prime mover which is a fraction of the size that would otherwise be required thereby also lowering the energy operating cost. Additionally, the present invention permits one small size fluid coupling to meet the full range of tension requirements in contrast to Oosthuizen et al. U.S. Pat. No. 4,842,274.

With Oosthuizen et al. U.S. Pat. No. 4,842,274, it is necessary to use different size fluid couplings for different force ranges which is clearly undesirable for meeting a wide range of operating parameters in various exercise devices. Finally, the present invention produces a safe, natural feeling exercise in both extension or eccentric and contraction or concentric movements without a multiplicity of sensors and controls in contrast to the exercise equipment that has been available and is disclosed in the prior art.

As for one other patent, U.S. Pat. No. 5,015,926 to Casler discloses a motorized system with an electrically controlled metallic powder or fluid clutch and feedback system which measures torque (force) and speed as well as direction of motion. The present invention differs in that the hydraulic coupling receives no feedback signal, the performance curve of the fluid coupling is fixed, and the control variable is the speed of the prime mover which drives the fluid coupling.

SUMMARY OF THE INVENTION

The present invention is generally directed to an exercise device which produces resistance to motion in use thereof. The operational components of the device can be adapted to an existing cable operated stacked weight machine in one application and, by way of example, can also be linked to a bicycle pedal or other rotating shaft as in a "pullover" machine. In either case, the present invention provides controlled resistance through a unique configuration of operational components.

Among the operational components of the inventive exercise device are a fractional horse power variable speed electric motor, an air cooled fluid coupling, and a torque multiplying speed reducer (the power package). The device is controlled by an encoder which senses a change of direction of motion of the exercise link and a pair of speed setting components which typically take the form of potentiometers. When the exercise device is used, the user sets the potentiometers to a desired resistance setting for each direction of motion and the two resistance forces are shown on a pair of digital panel meters.

In the case of cable operated equipment, the power package can be mounted to the main frame of the exercise device in the position formerly occupied by the stacked weights. The power package may include a cable drum upon which the operating cable is wound and unwound. The control panel may be separately mounted on the machine frame within easy reach of the user and within convenient viewing distance of the digital display. With this arrangement, the control panel may contain various components including motor "start" and "stop" controls and other controls and displays to facilitate the functioning and desirability of the invention.

Earlier it was noted that a unique feature of the invention is its ability to permit high velocity, sports specific training. Also, for those users interested in building increased strength in a much shorter time than is possible with conventional machines, the invention provides "heavy negative" training. To understand how these features are achieved, a typical operation of one machine will be illustrative, e.g., the latismuss pull down machine.

With the latismuss pull down machine, the user sets two potentiometers by turning the respective dials until the desired "positive" and "negative" tensions are displayed on the panel meters. The motor "start" button is then pushed and the motor accelerates to the speed necessary to apply the proper tension to the cable which is stopped at the top of the machine. At this point in time, the cable is tightly wound on the cable drum and the user may then pull as fast or as slow as desired to unwind the cable from the cable drum in the positive direction.

As is well known in the art, "power" is the product of force and velocity which means that the power generated in a particular exercise is dependent upon how fast the user pulls to unwind the cable from the cable drum in the positive direction. Since there are no weights and the inertia of the rotating components is very small, achieving high speed movement is possible with a more uniform application of force throughout the full range of motion than can be achieved with weighted resistance.

Without a heavy mass to accelerate at the start or decelerate at the end of motion, the user is able to more closely simulate throwing, kicking, hitting a ball, sprint swimming and the like. The user can thus achieve the maximum level of neuromuscular conditioning which is within his or her genetic capability. With cable speed being limited only by the strength of the user and the selected cable tension, the user may only be able to pull the cable slowly in the event the positive tension is set at a relatively high level.

Since cable speed information is provided by the encoder and selected tension is provided by one of the potentiometers, the two may be multiplied. The product of this multiplication will provide maximum or average power (watts) during an unwinding pull. Thus, the user is able to measure the effects of power training and determine the best proportion of speed and tension for maximum power.

When "heavy negative" training is desired, the user quite simply adjusts the negative or rewind tension of the exercise device to be greater than the positive or unwind tension. The negative or rewind tension may be on the order of twenty percent to forty percent greater than the positive or unwind tension. The user will typically be able to "feel" the ability to sustain resistance to the greater negative or rewind force with approximately the same mental and physical effort that was used to pull or unwind the cable from the cable drum. The negative or rewind portion of the exercise must necessarily be done slowly to achieve the maximum benefit. Muscle development will be much greater with a "heavy negative" as opposed to equal "positive" and "negative" resistances available with conventional selectorized or free weight equipment.

If, during the "heavy negative" training, the user weakens, the cable will rewind at a faster speed which automatically allows the tension to drop to a more comfortable level. At the end of the eccentric or negative motion, the user may let the exercise bar rest on the mechanical stop or, alternatively, the user may start the unwind pull (i.e., the concentric or positive motion) immediately. As soon as the latter motion begins to occur, the encoder signals the change in direction to the speed controls and the tension drops for the concentric (positive) motion.

These two training methods, i.e., "power" and "heavy negative", are unique features of the present invention that are not attainable with previously available equipment. However, the present invention can also be used conventionally, i.e., equal tensions can be applied on positive (concentric) and negative (eccentric) motions at slow speeds.

The present invention utilizes a fluid coupling which provides major advantages in simplifying the system controls and cycling from positive to negative tension is accomplished smoothly. There is no "hunting" or pulsations even at low tensions and the direction of rotation of the motor is unchanged at all times with the motor never being stalled under power. Finally, due to the location of the speed reduction, the average energy consumption of the exercise device is very low, e.g., 250 watts, thereby minimizing operating costs.

Other objects, advantages and features of the present invention will become apparent from a consideration of the following specification taken in conjunction with the accompanying drawings.

DETAILED DESCRIPTION OF THE PREFERRED EMBODIMENTS

Figure 1:
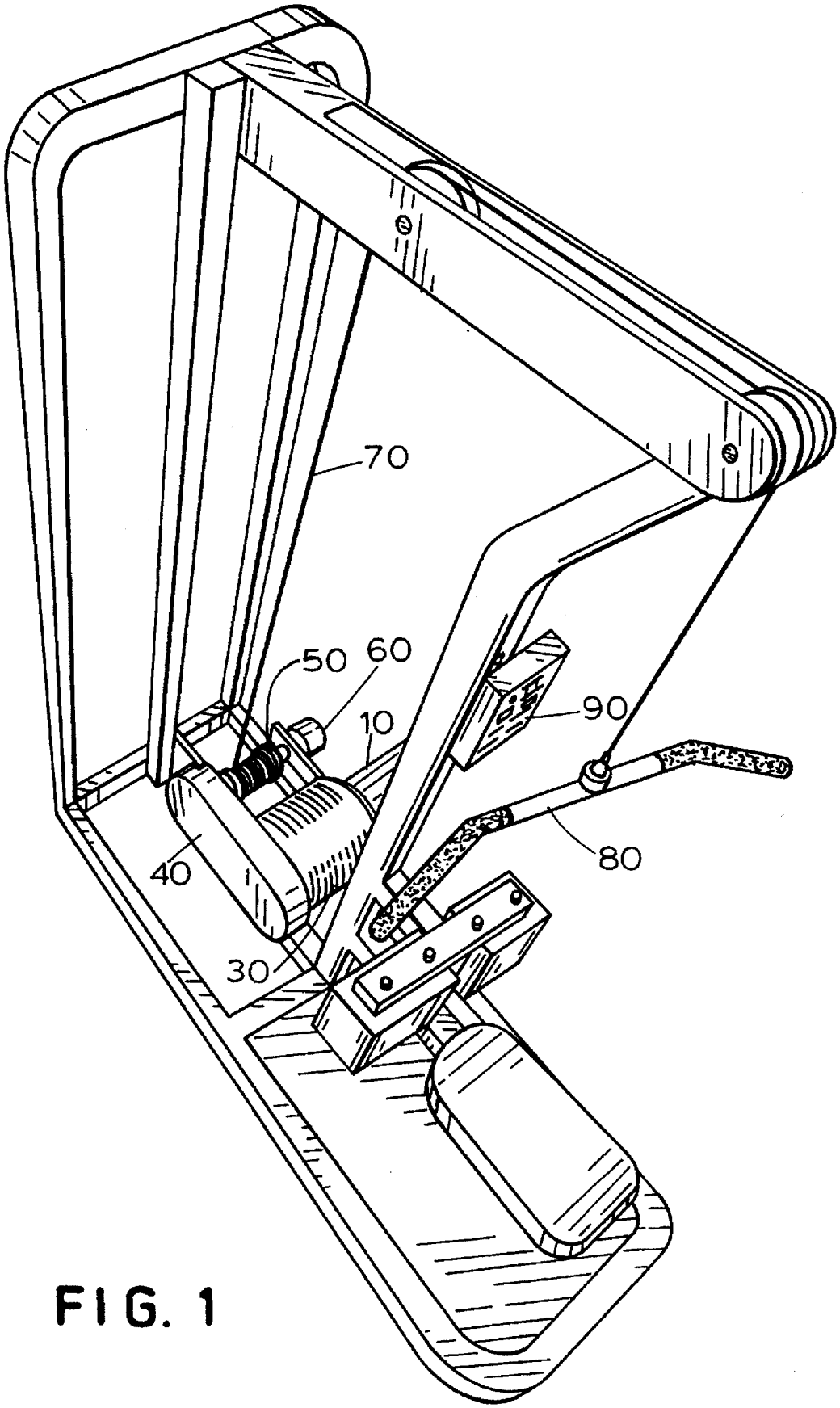
FIG. 1 is a perspective view of the present invention mounted on the frame of a latismuss pull down machine.

FIG. 1 is perspective view illustrating the invention mounted on an exercise machine, i.e., a latismuss pull down machine. It will be understood that the invention is well suited for use on virtually any other exercise machine. The electric motor 10, fluid coupling 30, torque multiplying unit 40, cable drum 50, encoder 60, cable 70, exercise link 80, and control panel 90 are also shown.

Figure 2:
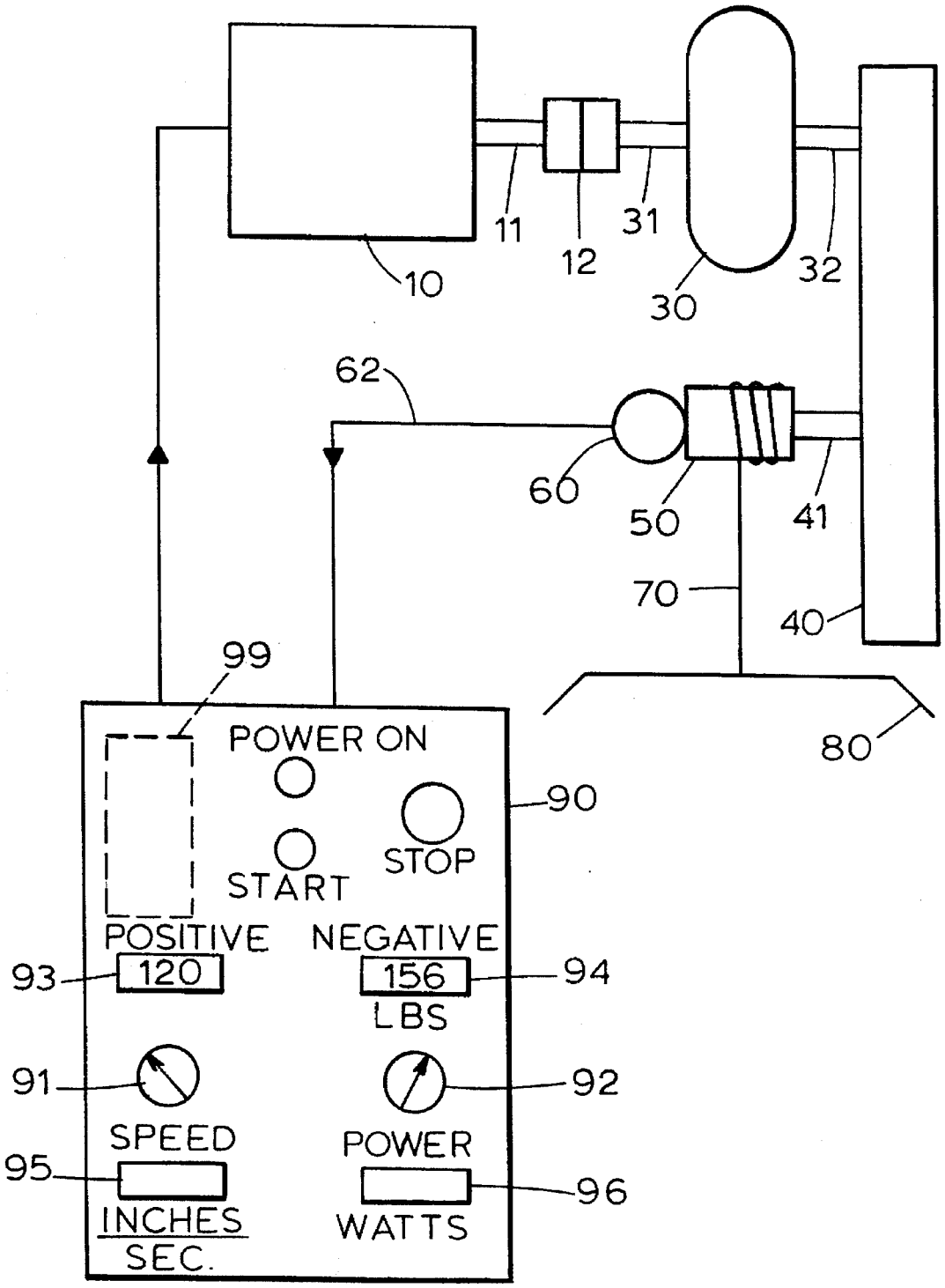
FIG. 2 is a schematic illustration of the operational components of the present invention as illustrated generally in FIG. 1.

FIG. 2 schematically illustrates the essential operational components of the present invention including the prime mover which comprises a variable speed electric motor 10 in the form of a direct current motor or alternatively an alternating current motor. The motor 10 has a motor shaft 11 which is connected by a conventional flexible coupling 12 to an input shaft 31 of the fluid coupling 30. The preferred embodiment of the fluid coupling 30 is of the type commonly known in the art as a hydro-kinetic coupling having a finned housing or, alternatively, a viscous shear coupling. This type of fluid coupling has radial blades (not shown) which are mounted on the input shaft 31 to pump encased fluid to a matching set of blades (not shown) which are mounted on an output shaft 32 of the fluid coupling 30. The preferred embodiment of the fluid coupling 30 transmits torque between the input and output shafts 31 and 32 by the flow of oil between the two sets of blades. The flow of oil is caused by the speed differential between the two shafts 31 and 32 which causes a difference in the dynamic head of the oil. As will be appreciated by those familiar with fluid couplings, the difference in the dynamic head of the oil determines the direction of oil flow and, thus, it also determines the power flow between the two output shafts 31 and 32.

From the foregoing, it will be understood that the fluid coupling 30 is accordingly permitted to act alternatively as a clutch when the cable 70 is rewound on the drum 50 or as a brake when the cable 70 is unwound from the drum 50. The fluid coupling output shaft 32 is coupled to a conventional torque multiplication unit 40 which may take the form of a timing belt reducer of a type known to those skilled in the art. The cable drum 50 is mounted on a torque multiplication unit output shaft 41. In addition, a speed and direction encoder 60 is coupled to the drum 50 and the signals from the encoder 60 are transmitted to the control panel 90 through conventional wires 62.

Within the control panel 90, and when a direct current electric motor is used, incoming alternating current is converted into variable voltage direct current. This is accomplished by a full wave rectifier 99 of a type commonly known in the art. As an alternative, an alternating current electric motor can be used which would require a variable frequency speed control.

When using a direct current electric motor, the control panel 90 has a positive speed setting dual cup potentiometer 91 which operates such that one cup sends a voltage signal to the full wave rectifier 99 to control the positive direct current voltage applied to the armature of the motor 10 to thereby determine its speed. The positive speed setting dual cup potentiometer 91 also operates such that the other cup thereof sends a different voltage signal to a positive digital panel meter 93 which shows the base cable resistance in pounds when the encoder 60 indicates that the cable drum 50 is rotating in the unwind direction. The base cable resistance is the actual force required to unwind the cable when it is at stall, i.e., zero speed which is equivalent to the resistance of a weight attached to a cable of an ordinary stacked weight exercise machine so long as the cable is moving slowly. As noted earlier, the actual cable resistance changes depending upon the actual cable unwind speed as the exercise link 80 is moved by the user.

Similarly, the control panel 90 has a negative speed setting dual cup potentiometer 92 which operates such that one cup sends a voltage signal to the full wave rectifier 99 to control the direct current negative voltage applied to the armature of the motor 10 to thereby determine its speed. The negative speed setting dual cup potentiometer 92 also operates such that the other cup thereof sends a different voltage signal to a negative digital panel meter 94 which shows the base cable resistance in pounds when the encoder 60 indicates that the cable drum 50 is rotating in the rewind direction. Accordingly, while the motor 10 is always turning in the same direction, its speed is controlled by either the positive or negative potentiometers depending upon the direction of rotation of the encoder 60.

In addition to the direction of rotation, the encoder 60 provides drum speed data to the control panel 90 which, on positive or unwind movement of the cable 70, is read as "cable speed" on the panel meter 95. The product of this "cable speed" and the positive resistance signal as shown on the positive digital panel meter 93 is recorded on the "power" digital panel meter 96. Other standard performance indicators common to exercise equipment such as "calories", number of "repetitions", "time" duration of exercise, etc. may be added as will be appreciated by those skilled in the art.

Similarly, "power on", "start", "stop", and other controls common to the safe use of electric motors are advantageously installed in the control panel 90.

Alternate methods for effecting the speed changes described above such as the use of programmable logic controllers, will be familiar to those skilled in the art of electric design and may be substituted for the dual cup potentiometers described hereinabove. In addition, and as set forth above, an alternating current electric motor with variable frequency speed control can be used and the speed changes can be achieved by using programmable logic controllers or dual cup potentiometers.

While in the foregoing there has been set forth a preferred embodiment of the invention, it will be appreciated that the details herein given may be varied by those skilled in the art without departing from the true spirit and scope of the appended claims.

I claim:

1. An exercise device comprising a variable speed rotary driving means, an adjustable speed control means for controlling the speed of said variable speed rotary driving means, an exercise link offering resistance to motion of a user, a fluid coupling connected to the variable speed rotary driving means through an input shaft, and a torque multiplying means driven by the fluid coupling through an output shaft, said fluid coupling transmitting torque from the input shaft to the output shaft, said torque multiplying means being connected to said exercise link, said fluid coupling imparting resistance to said exercise link, the resistance to motion of said exercise link being a function of the direction of said exercise link and the speed of said variable speed rotary driving means.

2. The exercise device of claim 1 wherein said variable speed rotary driving means is an electric motor.

3. The exercise device of claim 1 wherein said fluid coupling is of hydro-kinetic design.

4. The exercise device of claim 1 wherein said fluid coupling is of viscous shear design.

5. The exercise device of claim 2 wherein the speed of said electric motor is responsive to an encoder which determines the direction of movement of said exercise link.

6. The exercise device of claim 2 wherein the speed of said electric motor is controlled by preselected values determined by the user.

7. The exercise device of claim 1 wherein said adjustable speed control means includes both positive and negative resistance to motion adjustment controls.

8. The exercise device of claim 7 wherein said adjustable speed control means includes a control panel having means for indicating the speed of said exercise link.

9. The exercise device of claim 8 wherein said adjustable speed control means includes a control panel having means for indicating user maximum power for overcoming positive resistance to motion of said exercise link.

* * * * *